United States Patent [19]

Eckert et al.

[11] Patent Number: 5,048,385

[45] Date of Patent: Sep. 17, 1991

[54] INDEXABLE MULTI-TOOL FOR PUNCH PRESS

[75] Inventors: Richard M. Eckert, Amherest; Ronald C. Hill, Corfu, both of N.Y.

[73] Assignee: Strippit, Inc., Akron, N.Y.

[21] Appl. No.: 458,281

[22] Filed: Dec. 28, 1989

[51] Int. Cl.[5] ..... B26F 1/08; B26D 5/02

[52] U.S. Cl. ..... 83/34; 83/552; 83/571; 83/640; 83/50

[58] Field of Search ..... 83/552, 549, 563, 556, 83/559, 571, 138, 618, 640, 641, 34, 50; 234/109, 111, 113, 117, 118

[56] References Cited

U.S. PATENT DOCUMENTS

| | | | |
|---|---|---|---|
| 1,940,883 | 12/1933 | Rollings | 164/91 |
| 3,160,046 | 12/1964 | Bredow | 83/552 X |
| 3,527,130 | 9/1970 | Krehans | 83/552 X |
| 3,540,339 | 11/1970 | Killaly | 83/552 X |
| 4,096,774 | 6/1978 | Kaufmann | 83/552 |
| 4,220,062 | 9/1980 | Blanz | 83/71 |
| 4,250,785 | 2/1981 | Morishita et al. . | |
| 4,412,469 | 11/1983 | Hirata et al. . | |
| 4,532,845 | 8/1985 | Jinouchi | 83/552 |
| 4,546,683 | 10/1985 | Völkel et al. | 83/552 X |
| 4,555,966 | 12/1985 | Klingel | 83/571 X |
| 4,569,267 | 2/1986 | Klingel . | |
| 4,658,688 | 4/1987 | Shah et al. . | |
| 4,738,173 | 4/1988 | Kiuchi | 83/916 X |
| 4,779,329 | 10/1988 | Nordquist et al. | 83/522 X |
| 4,929,276 | 5/1990 | Chun et al. | 83/552 |

FOREIGN PATENT DOCUMENTS

| | | |
|---|---|---|
| 2267170 | 11/1975 | France . |
| 2169233 | 10/1985 | United Kingdom . |
| WO88/09232 | 12/1988 | United Kingdom . |

OTHER PUBLICATIONS

Brochure entitled: Finn-Power Turret Punch Presses for the 21st Century, ©1988, pp. 1-12.

Manual for Mate Finn-Power Multi-Tool, ©1988, pp. 1-8.

*Primary Examiner*—Frank T. Yost

*Assistant Examiner*—Kenneth E. Peterson

*Attorney, Agent, or Firm*—Hill, Van Santen, Steadman & Simpson

[57] ABSTRACT

A punch assembly which may be provided at a punching station in a turret punch press. The punch assembly includes a striker body having a solid portion, and a punch carrier which carries a plurality of individual punches. A selectively actuable stop holds the striker body stationary, allowing the punch holder to be rotated so that a predetermined one of the plurality of punches will underlie the solid portion of the striker body. Afterwards, the entire punch assembly may be rotated to a variety of angular orientations. At any of these orientations, the ram may be actuated to cause the punch to extend downwardly below the punch assembly and through a sheet of material. The rotation of the punch assembly to different orientations allows a single punch to be used to punch holes of the shape but with differing angular orientations. The die holder receives a plurality of corresponding dies having openings therein corresponding to the punches. The die holder is rotatable to maintain constant alignment between corresponding punches and dies.

24 Claims, 3 Drawing Sheets

INDEXABLE MULTI-TOOL FOR PUNCH PRESS

CROSS-REFERENCE TO RELATED APPLICATION

This application is related to commonly assigned and co-pending U.S. Application Serial No. 351,413 filed May 12, 1989, the specification of which is incorporated by reference herein.

BACKGROUND OF THE INVENTION

The present invention relates generally to a punch press having a pair of upper and lower tool holders mounted to automatically bring respective punch and die sets to a work station for punching a variety of holes in sheet materials. More particularly, the invention relates to an apparatus for rotating a set of punches and dies in a tool holder at a single punching station in the press in a manner such that each punch and die is rotatable within the tool holder for punching a wider variety of holes with a reduced set of tools.

U.S. Pat. No. 4,658,688, assigned to the assignee of the present application, the specification of which is incorporated by reference herein. This patent discloses a turret punch press having upper and lower turret tool holders which carry a number of punch and die sets in individual tool holding stations in the turrets. At least one of the corresponding tool holding stations in the upper and lower turrets is indexable to different angular orientations. Rotation of the indexable punch tools is accomplished by a slidably mounted motor for engagement with a timing pulley, which, through a timing belt and harmonic gear drive, acts to rotate the tool holder which carries the punch and die set. In this device, each of the turrets may be equipped with tool stations which receive tool support devices that are rotatable to selectively position the tools at chosen angular positions by rotating the tool sets about their longitudinal axes.

U.S. Pat. No. 4,569,267 discloses a punch press which uses a punch tool assembly which contains at least two punch pins of different diameters or cross-sections. The punch pins are interchangeable in the working position by a control element which is slidable or rotatable about a pin support member. When the punch tool assembly is rotatable about the ram to effect the movement of the punch pins from operative to inoperative positions, a cooperating movable die is provided in order to ensure that the aligned die bores are cooperatively dimensioned and configured with respect to the punch pins. The punch tool assembly is held on the ram and moves with the ram and the pins, when not being used, are held in an elevated position while the operative pin is rigidly locked into a protruding position.

It has also been known to provide multiple tool holding members to be dropped into the individual rotatable stations, for example a station of the general type referred to in the aforementioned U.S. Pat. No. 4,658,688. Such devices are commercially available and are known as "multi-tools". When assembled in a indexable station, the drive mechanism to rotate the indexable station will be affected to rotate the multi-tool carrying member so as to present individual tools thereof into a ram-actuable position.

In this manner, particularly when using a turret punch press, the punch press may be equipped with a plurality of circumferentially spaced individual tool receiving openings which are aligned between the top and bottom turrets such that the top turret carries a punch tool and the bottom turret carries a complementary die tool, each of which can be indexed by rotation of the turrets to a position at the work station under the ram. Further, one or more of the individual stations of the turret may be provided with indexing mechanisms such that individual tools carried at those stations may be rotated about their axes to provide different angular orientations under the ram. In this manner, openings of the same shape but different angular orientation may be provided in the work piece with the same punch and die pair.

Further, a miniature turret or tool carrier carrying a plurality of individually circumferentially spaced tools may be received in one of the indexable stations in a turret such that indexing of the indexable station will rotate a selected one of the punch and die tools to the ram actuating work station.

While each of these devices provides a singular increase in productivity, they are, at least for the last two mentioned styles of device mutually exclusive. Thus, a single station of a turret may provide rotatability for a single tool about its axis, or a multi-tool may provide rotatability for a plurality of tools to present them one at a time at a fixed angular position.

SUMMARY OF THE INVENTION

This invention contemplates a punch assembly which may be provided at an indexable punching station in a punch press, wherein the punch assembly includes a striker body having a solid portion, and a punch carrier which carries a plurality of individual punches. A selectively actuable stop holds the striker body stationary, allowing the punch holder to be rotated so that a predetermined one of the plurality of punches will underlie the solid portion of the striker body. Afterwards, the entire punch assembly may be rotated to a variety of angular orientations. At any of these orientations, the ram may be actuated to cause the predetermined punch to extend downwardly below the punch assembly and through a sheet of material. Rotation of the assembly thus permits a single punch to be used to punch holes of the same shape but with differing angular orientations.

The die holder receives a plurality of corresponding dies having openings therein corresponding to the punches. The die holder is rotatable to maintain constant alignment between corresponding punches and dies.

DESCRIPTION OF THE PREFERRED EMBODIMENTS

Figure 1:
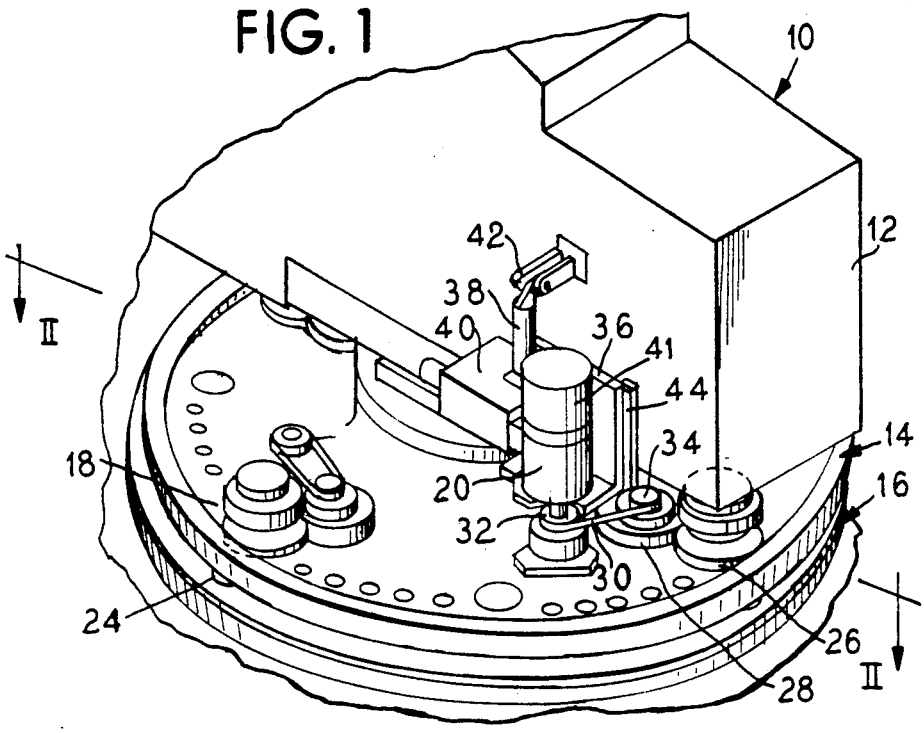
FIG. 1 is a perspective view of an upper turret portion of a device according to the principles of the present invention.

Referring to FIG. 1, the device of the present invention is shown generally at 10 and includes a punch press housing 12, an upper rotatable turret 14 and a lower rotatable turret 16, at least one indexable multi-tool holder 18 including a punch assembly 19 (FIG. 3), and a drive motor 20. More specifically, a ram 22 (FIGS. 3 and 4) is disposed in the punch press housing 12 for driving a punch P through a piece of sheet material M and into a die D. A plurality of punches P and dies D are mounted adjacent the perimeter of respective upper and lower turrets 14 and 16 which are rotatable to bring corresponding punches P and dies D under the ram 22. At least one indexable multi-tool holder 18 is mounted within the rotatable upper turret 14, and a corresponding indexable die 24 is mounted in the lower turret 22 so that the multi-tool holder 18 and die 24 ma be brought into registration under the ram 22.

The multi-tool holder 18 is provided with a geared bushing 26 that is rotatably driven by a gear box 28 which in turn is driven by timing belt 30 connecting a pair of pulleys 32 and 34. The servo motor 20 is mounted on the punch press housing 12 by a vertical slide 36 and is selectively engageable to the drive pulley 32. Vertical movement of the servo motor 20 with the slide 36 is provided by an actuator 38 (e.g. as a pneumatic actuator), connected between the slide 36 and the punch press housing 12. The servo motor 20 may be locked into its respective upper and lower positions by a slide lock mechanism 40. A resolver 41 provides feedback from the motor 20 to a programmed controller (not shown) to monitor the angular rotation of the motor 20.

The actuator 38 is connected at an upper end thereof to the punch press housing 12 by a bracket 42. The actuator 38 is connected to the slide 36 on which the motor 20 is mounted. The slide 36 slides vertically within slide rails 44,45 so that the motor 20 may be selectively engaged with the driver pulley 32.

Figure 2:
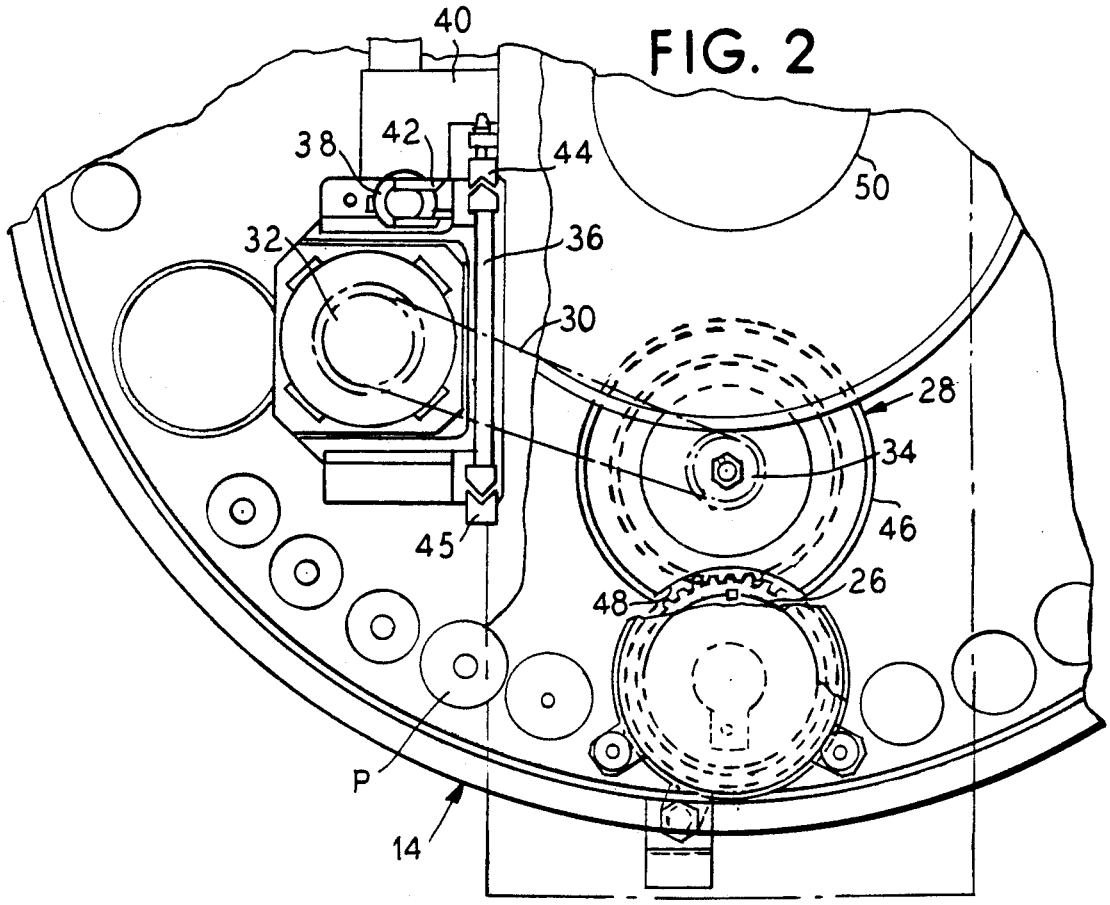
FIG. 2 is a plan view of the device shown in FIG. 1 taken generally at line II—II.

FIG. 2 shows the upper turret 14 from above. The slide 36 is mounted between the V-shaped slide rails 44 and 45. The actuator 38 is seen suspended from the bracket 42 and the slide lock 40 can be seen more clearly. The timing belt 30 extends from the drive pulley 32 to the second pulley 34 under the housing 12. The gear drive 28 is enclosed by a housing 46 having a shaped opening 48 through which extends the geared bushing 26 of the indexable multi-tool holder 18. The turret 14 is rotatable about a turret axis 50 to bring other punch tools P under the ram 20.

Figure 3:
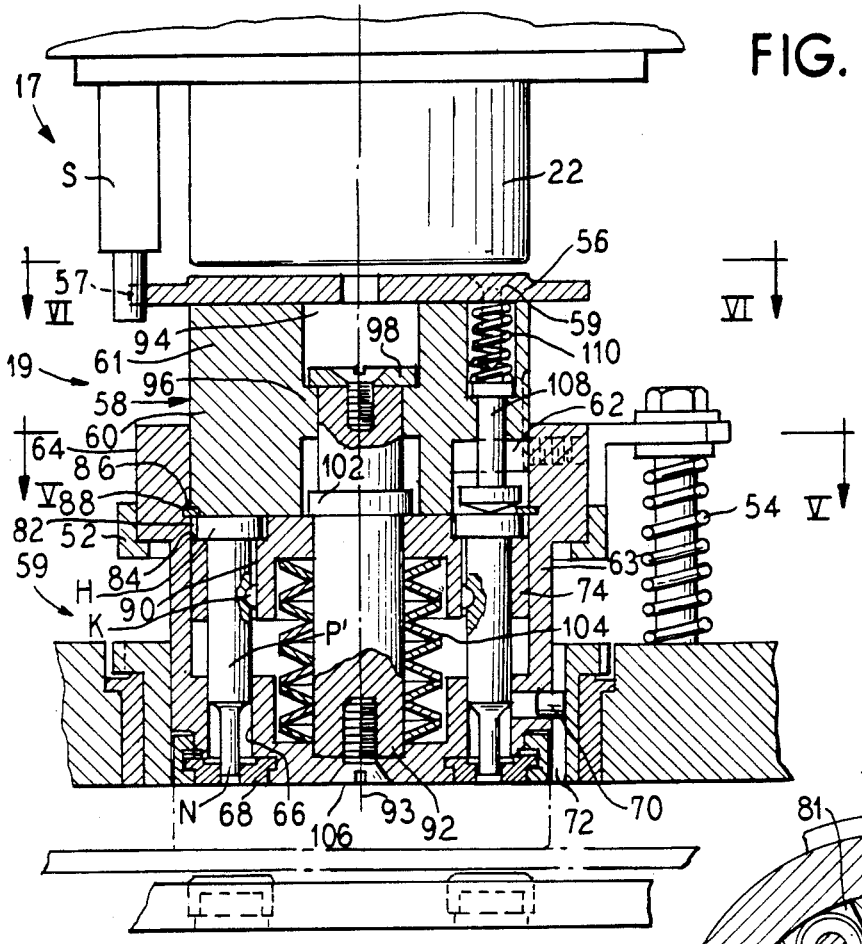
FIG. 3 is a cross-sectional view of a punching tool assembly embodying the present invention.
Figure 4:
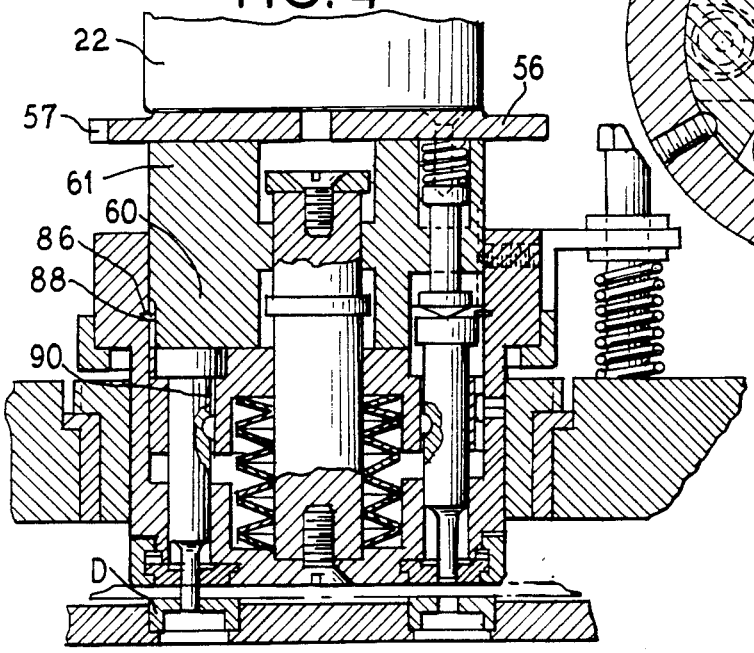
FIG. 4 is a cross-sectional view of the device shown in FIG. 3, showing the punch assembly in a punching position.

As seen in FIG. 3 the indexable punch assembly 19 is provided with an annular lifter ring 52 extending therearound which is connected to lifter springs 54 extending from the turret 14 to the lifter ring 52. The ram 22 is shown above the punch assembly 19 and, during operation, will drive a predetermined punch P' through a piece of sheet material M and into the die 24. The lifter ring 52, in conjunction with the springs 54, then returns the punch assembly 19 to its original position lifting it from the sheet material M. A portion of the lower turret 16 is shown, and includes the indexable die assembly 24 which is rotated by an arrangement similar to that used to rotate the indexable punch assembly 19.

The punch assembly 19 is shown positioned below the ram 20 in a ready to work position. The punch assembly 19 includes a top striker cap 56 which is engaged by the ram 22 during punching. The cap 56 is secured to a striker body 58 by appropriate fasteners 59 such as threaded fasteners (see also FIG. 6). The striker body 58 is generally annular and, as seen in phantom in FIGS. 5 and 6, includes a solid portion in the form of a striker member 60 which selectively overlies a predetermined one of the punches P carried in the punch assembly 19. The striker member 60 extends axially downwardly from a main upper annular portion 61 of the striker body, thus leaving a relieved area 62 in the remaining circumferential area below the main upper body portion 61.

The top striker cap 56 is provided with at least one groove 57 which is selectively engaged by a pneumatically operated striker lock S to secure the striker cap 56 and the striker body 58 against rotation, as will be set forth in greater detail hereinbelow.

The punch assembly 19 includes a lifter sleeve member 63 that is normally supported on a stripper guide 64. The stripper guide 64 forms a lower outer portion of the indexable punch assembly 19 and includes vertical passages 66 for receiving a lower portion of the punches P. The stripper guide 64 also removably receives stripper buttons 68 as described in greater detail below. The stripper guide 64 is vertically reciprocally positioned within the geared bushing 26 and is keyed to the bushing 26 by an appropriate guide member such as a radially projecting pin 70 carried by the stripper guide 64 which is received in a vertical slot 72 in the bushing 26. Thus the stripper guide 64 will be free to move vertically relative to the bushing 26, however, will be prevented from rotating relative thereto.

Figure 5:
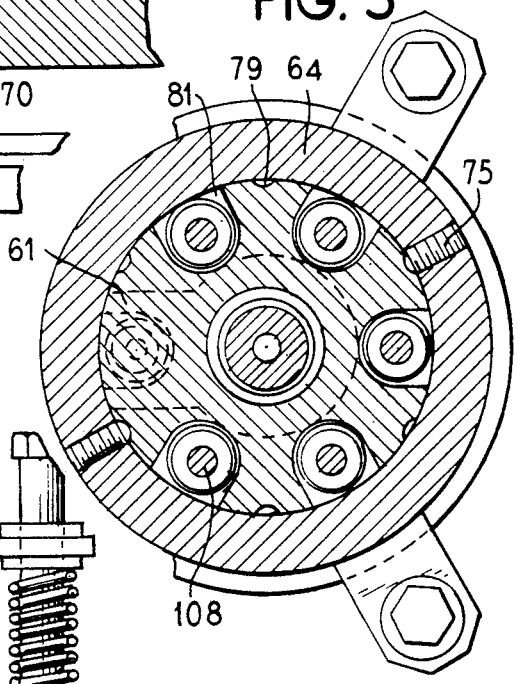
FIG. 5 is an elevational view of the device shown in FIG. 3 along line V—V.
Figure 6:
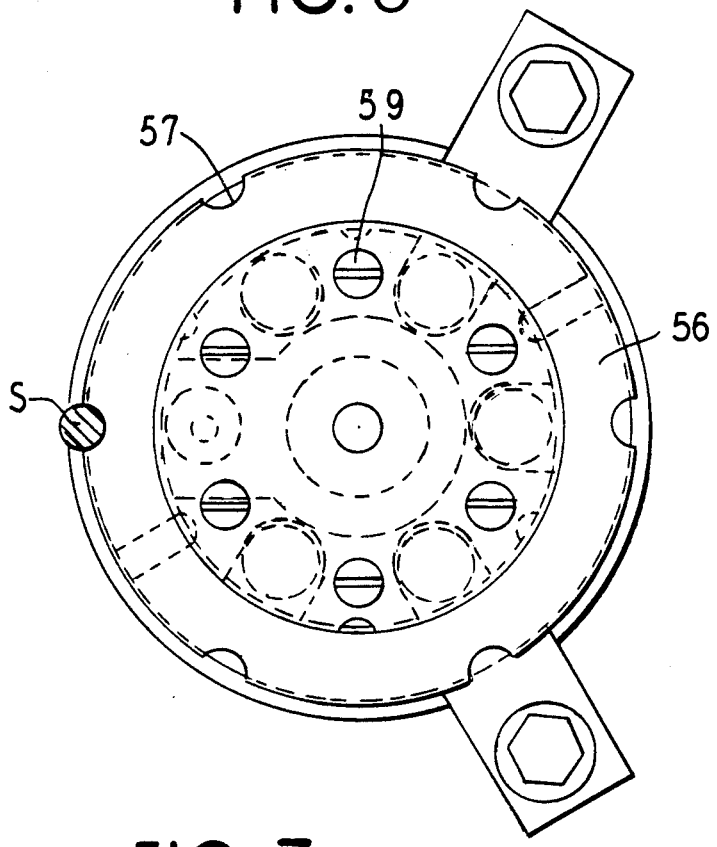
FIG. 6 is a cross-sectional view of the device shown in FIG. 3 along line VI—VI.
Figure 7:
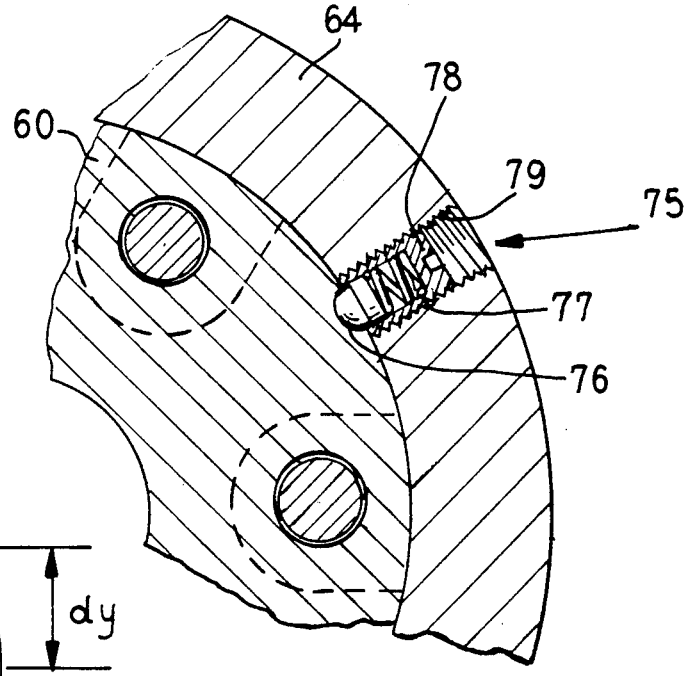
FIG. 7 is a broken-away detail of FIG. 5.

The stripper guide 64 surrounds a punch carrier 74 and is selectively retained in predetermined rotational positions by appropriate detents, shown here as a plurality of radially inwardly projecting spring-loaded ball detent 75. Each ball detent 75, as shown in FIG. 7, includes a ball member 76 biased outwardly by a spring 77 and guided and retained by a threaded cylindrical member 78. The ball detents 75 are secured in threaded bores 79 through the stripper body 64. The ball members 58. The ball detents 75 and 79 grooves are positioned to correspond to the predetermined relative rotational positions of the striker body and the punch carrier. As shown in FIG. 5, two ball detents 75 may be provided on opposite sides of the punch assembly 19. Thus, the punch carrier 74 and the striker body 64 will be resiliently retained in one of a plurality of rotational positions relative thereto.

The punch carrier 74 has a plurality of vertically oriented passages 81 in which are received upper portions of the punches P. The punches P each have an enlarged head H which is received in an annular recessed area 82 formed at the top end of the punch carrier 74. A shoulder 84 is formed at the surface formed by the recessed area 82 which supports the head H of the punch P. The stripper guide 64 extends to an elevation above the head H of the punches P and a retaining ring 86 is snapped into a groove 88 in the stripper guide 64 to closely overlie the heads H of the punches.

Each of the punches P normally has a key K which is received in a vertical slot 90 in the punch carrier 74 to keep the punch angularly oriented within the punch carrier assembly 19. This is particularly required when the punch P does not have a circular working end W.

A center post 92 having a longitudinal axis 93 is used to hold the punch carrier 74 against the striker body 58. The center post 92 is positioned within a central vertical passage 94 in the striker body 58. The central vertical passage 94 includes an annular shoulder 96 which projects into tho passage 94 and the post 92 includes a post cap 98 which is removably secured to the post 92 by an appropriate fastener 100, shown here as a threaded fastener, such that the post will be prevented from moving downwardly relative to the striker body 58 once the cap 98 engages the shoulder 96.

The post 92 also has an annular shoulder 102 formed thereon which is positioned below the striker body shoulder 96, and which overlies the punch carrier 74. The punch carrier 74 is pressed against the post shoulder 102 by means of an appropriate resilient or elastic member 104, which may be in the form of a conical spring or Belleville washer. A bottom end of the post 92 is secured to the stripper guide 64 by an appropriate fastener 106, such as a threaded fastener. In this manner, the entire punch tool assembly 19 is held together.

In operation, the striker lock S is brought into engagement with one of the grooves 57 of the top striker cap 56, thus securing the striker cap 56 and the striker body 58 against rotation. The motor 20 is then actuated by the control system for the punch press, preferably a CNC control system (not shown), to act through the pulleys 32 and 34 to rotate the geared bushing 26. Rotation of the geared bushing 26 by the punch press control causes rotation of the portion of the punch assembly 19 about the axis 93 below the striker body 58, which thus places the striker body 58 and the punch carrier 74 in a predetermined relative position in which a selected punch P′ is in a working position below the striker member 60, while disposing the other punches carried in the stripper guide 64 in an inactive position under the recess 62. Movable skid posts 108 are biased downwardly by resilient members, shown here as springs 110. The skid posts 108 and the retaining ring 86 prevent the inactive punches P from bouncing upwardly in the punch assembly 19 in response to vibrations of the punch press 10. In this manner, only one punch P′ is moved to a working position while all of the other punches P are held in an inactive position.

After the predetermined punch P′ has been moved to a position beneath the striker member 60 the striker lock S is retracted, thus permitting rotation of the entire punch assembly 19 to move the punch P′ to a predetermined angular orientation. This capability is particularly significant when the punch P′ does not have a circular working end W, since it permits a single punching tool to punch holes of the same shape, but with different angular orientations, through the sheet material M.

As mentioned previously, the die assembly 24 is rotated and maintained in alignment with the punch assembly 19 using an arrangement similar to that used to rotate the punch assembly 19.

During punching of the sheet material, the ram 20 descends and strikes the striker plate 56 causing the entire punch assembly 19 to move downwardly. The lifter ring 52 moves downwardly against the bias of the lifter springs 54. When the entire punch assembly has moved downwardly enough to cause the stripper buttons 68 to engage the sheet material M, as shown in phantom in FIG. 4, the punch carrier 74 moves downwardly relative to the stripper guide 64 thus compressing the resilient member 104. As this occurs, the striker body 58, through the striker member 60, continues to press against the predetermined punch P′, resulting in the punch P′ being extended beyond a bottom of the stripper button 68 and through the material M into a die D′. The remaining punches P which are not beneath the striker member 60 are retained by the skid posts 108 which are carried on the striker body 58 in the recessed area 62. The springs 110 are weaker than the resilient member 104 and therefore, once the other punches P engage the sheet material M, those other punches P will stop t heir downward movement relative to the material M. Only the ram 20, striker plate 56, striker body 58, and the individual punch P′ under the striker member 60 will continue the downward movement to pierce through the material M.

When the ram 20 has terminated its downward stroke and begins to move upward, first the extended punch will move upwardly by action of the resilient member 104, then the entire punch assembly 19 will move upwardly by action of the lifter springs 54.

Figure 8:
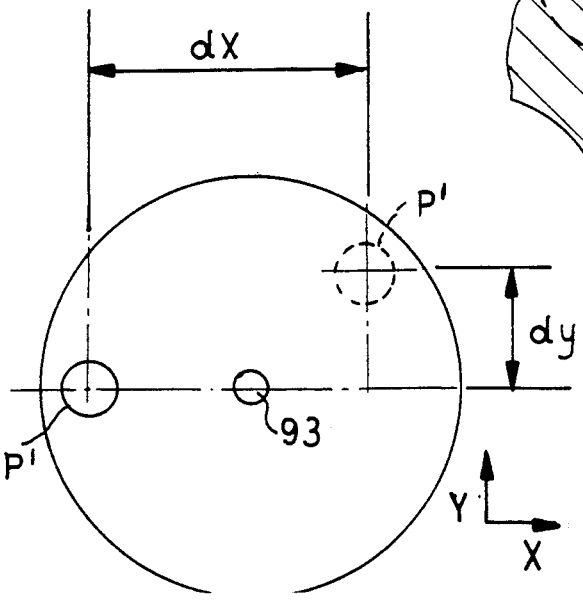
FIG. 8 is a schematic sectional view demonstrating the planar displacement incurred as a result of punch tool rotation.

As can be seen in FIG. 8, when the predetermined punch P′ is rotated to various positions about the axis 93 it will, of course, be displaced in a plane parallel to the material M. For example, in rotating from a position shown in solid line to that shown in broken line in FIG. 8, the punch P′ will be displaced a distance $D_x$ along the X axis and Dr along the Y axis of a plane parallel to the sheet material M.

In a known fashion, the control system of the punch 10 continuously senses the rotational position of the punch assembly 19, and thus of the punch P′. The control system can thus be programmed very simply to calculate the extent and direction of the aforementioned displacement, and to accommodate the same by positioning the sheet M accordingly. The details of such accommodation will be easily ascertained by those skilled in the art of machine tool programming.

After a desired number of holes have been punched through the sheet material M with the punch P′ in one position, the above process may be repeated in whole or in part. The motor 20 may be actuated to rotate the punch assembly 19 to a different orientation, thus permitting the punch P′ to be used to punch holes having a different orientation, or the striker lock S may be actuated and the process repeated to select a different punch P.

Although the present invention has been described with reference to a specific embodiment, those of skill in the art will recognize that changes may be made thereto without departing from the scope and spirit of the invention as set forth in the appended claims.

We claim:

1. In a punch press having at least one indexable tool station and a selectively actuable ram, a multi-tool holder disposed in said indexable station and comprising the following:

a punch press assembly including a punch carrier bearing a plurality of punching tools, and a striker body having a striker member, said punch carrier being selectively rotatable with and movable with respect to said striker body; and a lock selectively actuable to retain said striker body against rotational movement while permitting movement of said punch carrier;

whereby said striker member may be positioned over a predetermined one of said punching tools by movement of said punch carrier with respect to said striker body, and said ram may be actuated to drive to said predetermined punch tool to punch holes of identical shape, but with different angular orientations, by rotation of said punch carrier with said striker body.

2. A multi-tool holder according to claim 1, further comprising at least one recess on said striker body and capable of selective engagement with said lock.

3. A multi-tool holder according to claim 2, wherein said striker body comprises a striker plate upon which said recess is located.

4. A multi-tool holder according to claim 1, further comprising a detent assembly capable of retaining said striker body and said punch carrier in any one of a plurality of predetermined relative positions.

5. A multi-tool holder according to claim 4, wherein said detent assembly comprises the following:

a plurality of generally vertical grooves in an outer surface of said striker body, each of said grooves corresponding to a respective one of said predetermined relative positions; and at least one ball detent secured in said punch carrier, said at least one ball detent being resiliently biased toward contact with said striker body and receivable in said grooves.

6. A multi-tool holder according to claim 5, wherein said at least one ball detent comprises a pair of ball detents located on opposite sides of said punch assembly.

7. A turret punch press comprising the following:

a press frame supporting rotatable upper and lower turrets, each of said turrets including a plurality of sets of circumferentially spaced tool holding stations, each of said sets including an upper station in said upper turret and a corresponding lower station in said lower turret;

at least one of said sets of tool holding stations being an indexing set that is provided with means for rotating tool holders received therein;

a multi-tool holder comprising a punch carrier with a plurality of spaced apart punch-carrying openings therein with punches in said openings, said multi-tool holder being received in the upper station of said at least one indexing set;

a die carrier bearing a plurality of dies corresponding to said punches, said die carrier being received in the lower station of said at least one indexing set below said multi-tool holder, whereby a punch in each of said punch-carrying openings of said punch carrier will mate with a die carried by said die carrier;

said multi-tool holder including a striker body having a striker member, said punch carrier being selectively rotatable with said striker body and movable with respect to said striker body; and a lock selectively actuable to retain said striker body against movement when said punch carrier of said multi-tool holder is moved by said indexing set.

8. A multi-tool holder according to claim 7, further wherein said punch carrier of said multi-tool holder further comprises a stripper guide generally coaxially surrounding said punch carrier and said striker body.

9. A multi-tool holder according to claim 8, further comprising a detent assembly for selectively retaining said striker body and said punch carrier in any one of a plurality of predetermined relative positions.

10. A multi-tool holder according to claim 9, further wherein said detent assembly comprises the following:

a plurality of generally vertical grooves in an outer surface of said striker body, each of said grooves corresponding to a respective one of said predetermined relative positions; and at least one ball detent secured in said punch carrier, said at least one ball detent being resiliently biased toward contact with said striker body and receivable in said respective grooves.

11. A multi-tool holder according to claim 10, wherein said at least one ball detent of said detent assembly is secured in at least one bore extending through a wall of said stripper guide.

12. A multi-tool holder according to claim 11, wherein said at least one ball detent comprises a pair of ball detents located on opposite sides of said punch assembly.

13. A multi-tool holder according to claim 7, further comprising at least one recess on said striker body capable of selective engagement with said lock.

14. A multi-tool holder according to claim 13, wherein said striker body comprises a striker plate upon which is located said recess.

15. A method of punching holes of similar configuration, but with differing angular orientations, in sheet material, said method comprising the following steps:

providing a multi-tool holder including a striker body having a striker member, said multi-tool holder further including a punch carrier for holding a plurality of punching tools, said punch carrier being selectively positionable with respect to said striker body;

placing said striker body and said punch carrier in a predetermined relative position in which said striker member of said striker body is aligned over a predetermined one of said plurality of punching tools;

rotating said multi-tool holder to a plurality of predetermined orientations; and actuating said predetermined punching tool to punch at least one hole while said punch assembly is in each of at least two of said predetermined orientations.

16. A method according to claim 15, wherein said step of placing comprises selectively affecting relative rotation of said punch carrier with respect to said striker body about a common longitudinal axis.

17. A method according to claim 16, wherein said relative rotation is affected by selectively securing said striker body against rotation while imparting rotational movement to said punch carrier.

18. A method according to claim 15, further comprising the step of selectively retaining said striker body and said punch carrier in said predetermined relative positions.

19. A method according to claim 15, further comprising the following steps:

sensing a degree of rotational displacement of said predetermined punch;

calculating an amount of planar displacement of said predetermined punch caused by said rotational displacement; and placing said sheet material in a position to accommodate said planar displacement.

20. A method of punching holes of different angular orientations in sheet material, said method comprising the following steps:

providing a multi-tool holder including a striker body having a striker member, said multi-tool holder further including a punch carrier for holding a plurality of punching tools, said punch carrier being selectively positionable with respect to said striker body;

placing said striker body and said punch carrier in a first predetermined relative position in which said striker member of said striker body is aligned over a first predetermined one of said plurality of punching tools;

rotating said multi-tool holder to a plurality of predetermined orientations;

actuating said first predetermined punching tool to punch at least one hole while said multi-tool holder is in each of at least two of said predetermined orientations;

placing said striker body and said punch carrier in a second predetermined relative position in which said striker member of said striker body is aligned over a second predetermined one of said plurality of punching tools;

rotating said multi-tool holder to a plurality of predetermined orientations; and actuating said second predetermined punching tool to punch at least one hloe while said multi-tool holder is in each of at least two of said predetermined orientations.

21. A method of changing the angular orientation of a punching tool so that said punching tool can be actuated to punch holes of identical shape, but with different angular orientations, said method comprising the steps of:

providing a punch press having at least one indexable station;

providing a multi-punching tool carrier bearing a plurality of punching tools at said station;

providing a striker for said carrier capable of acting on only one of said punching tools at a time;

rotating one of said striker and carrier by indexing said station to align said striker with a selected one of said punching tools;

rotating said striker and said carrier by indexing said station to position said one tool at a desired angular orientation.

22. In a punch press of the type including a plurality of tool stations selectively positionable beneath a selectively actuable ram, a multi-tool holder disposed in one of said tool stations and comprising the following:

a punch carrier bearing a plurality of punching tools;

a striker body capable of selectively acting on any one of said punching tools at a time; and means for positioning said striker body and said punch carrier such that said ram can be actuated to cause a predetermined one of said punching tools to punch holes of identical shape, but with different angular orientations, by rotation of said punch carrier with said striker body.

23. A method of changing the angular orientation of a punching tool so that said punching tool can be actuated to punch holes of identical shape, but with different angular orientations, said method comprising the steps of:

providing a punch press having at least one indexable station;

providing a multi-punching tool carrier bearing a plurality of punching tools at said station;

providing a striker for said carrier capable of acting on only one of said punching tools at a time;

affecting relative movement between said striker and carrier to align said striker with a selected one of said punching tools;

rotating said striker and said carrier by indexing said station to position said selected one of said punching tools at a desired angular orientation.

24. A multi-tool holder comprising the following:

a punch carrier bearing a plurality of punching tools;

a striker capable of selectively acting on any one of said punching tools, one at a time; and means for positioning said striker and said punch carrier such that a ram can be actuated to cause a predetermined one of said punching tools to punch holes of identical shape, but with different angular orientations, by rotation of said punch carrier with said striker body.

* * * * *